United States Patent [19]

Sakashita

[11] 4,162,644

[45] Jul. 31, 1979

[54] AUTOMATIC RHYTHM ACCOMPANIMENT APPARATUS IN AN ELECTRONIC ORGAN

[75] Inventor: Masao Sakashita, Kitamoto, Japan

[73] Assignee: Kabushiki Kaisha Kawai Gakki Seisakusho, Hamamatsu, Japan

[21] Appl. No.: 846,208

[22] Filed: Oct. 27, 1977

[30] Foreign Application Priority Data

| | | | |
|---|---|---|---|
| Oct. 30, 1976 | [JP] | Japan | 51-130053 |
| Nov. 11, 1976 | [JP] | Japan | 51-134660 |
| Nov. 12, 1976 | [JP] | Japan | 51-135143 |
| Nov. 26, 1976 | [JP] | Japan | 51-157500[U] |

[51] Int. Cl.[2] ..... G10H 1/00; G10H 5/00

[52] U.S. Cl. ..... 84/1.03; 84/DIG. 2; 84/DIG. 12; 84/DIG. 22

[58] Field of Search ..... 84/1.01, 1.03, 1.17, 84/1.24, DIG. 2, DIG. 12, DIG. 22

[56] References Cited

U.S. PATENT DOCUMENTS 3,986,424 10/1976 Sakashita ..... 84/1.03

*Primary Examiner*—Stanley J. Witkowski

*Attorney, Agent, or Firm*—Haseltine, Lake & Waters

[57] ABSTRACT

An automatic accompaniment apparatus in an electronic organ having a keyboard for melody provided with a plurality of key switches for accompaniment, respective ends of the key switches being connected to a voltage generating circuit and respective opposite ends of the key switches being connected to a chord gate circuit through memory circuits. A key selection circuit for selecting a key of music is provided so that a rhythm accompaniment tone corresponding to a melody is obtained as an output signal from the chord gate circuit. A rhythm pulse is generated from a rhythm pulse generator. Connected between the key switches and the voltage generating circuit is a switch element and a keying pulse generator connected to the switch element. A delay circuit is connected to the output of the keying pulse generator and an inverter is connected to the delay circuit and to the switch element such that the inverter is activated by a first pulse in one bar of the rhythm pulse generator to generate a signal for bringing the switch element into on position whereas the switch element is brought into off position by a signal generated by a delay pulse from the delay circuit.

6 Claims, 16 Drawing Figures

KEY SWITCH ON
STOP SWITCH ON
KEY SWITCH ON
KEY SWITCH ON
KEY SWITCH ON
STOP SIGNAL
1 BAR
1 BAR
1 BAR
P1
P2
SS
SP1
SP2
SP3
SP4
H
L

AUTOMATIC RHYTHM ACCOMPANIMENT APPARATUS IN AN ELECTRONIC ORGAN

FIELD OF THE INVENTION

This invention relates to an automatic rhythm accompaniment apparatus.

PRIOR ART

The inventor has previously proposed an automatic rhythm accompaniment apparatus comprising a plurality of chord memory circuits detecting a first tone of each bar of a melody played by operation of a keyboard and memorizing it as a chord for a period of one bar and a gate circuit driven by outputs from the chord memory circuits and a rhythm pulse from a rhythm pulse generator, so that a rhythm accompaniment tone of a chord corresponding to the first one of each bar may be obtained by opening and closing of the gate circuit (see U.S. Pat. No. 3,986,424).

This apparatus is excellent in that a rhythm accompaniment tone can be obtained automatically by playing a melody, and results in an easy performance with an accompaniment by a beginner.

The apparatus, however, has the disadvantage that after playing of a certain bar is ended and when going into playing of the next bar, if the timing of the depression for the next bar is delayed, a time period is produced in which a rhythm tone is not generated. Further, the apparatus is so constructed that a key has to be depressed during the time when a rhythm pulse of a first beat in one bar is being generated, which has the disadvantage that in the case where melody has a pause corresponding to the first beat, or in similar cases, depressing of the key is to be made after a rhythm pulse of the first beat has disappeared, so that no rhythm tone is produced at all regarding that one bar.

SUMMARY OF THE INVENTION

An object of this invention is to provide apparatus to remove such deficiencies such that even when depressing of a key for the first tone in a certain bar of a melody is delayed a chord selected in the preceding bar is accompanied, and therefore when that key is then depressed a chord corresponding to the melody tone is newly accompanied regardless of the time when that key is depressed, to prevent an interrupted condition producing neither melody nor accompaniment, or music without accompaniment.

A further object of this invention is to provide an apparatus having an accompaniment keyboard of one finger type and when this keyboard is operated, a one finger accompaniment tone can be obtained with priority over a rhythm accompaniment by operation of the foregoing melody keyboard.

A further object of the invention is to provide an apparatus in which the accompaniment keyboard of one finger type is provided with a minor chord selection switch, so that when the switch is operated together with the accompaniment keyboard, a minor chord is obtained, and when the accompaniment keyboard is operated without operation of the switch, it is changed automatically into a major chord, and thus changeover between the major chord and the minor chord can be easily carried out.

DETAILED DESCRIPTION

Figure 1:
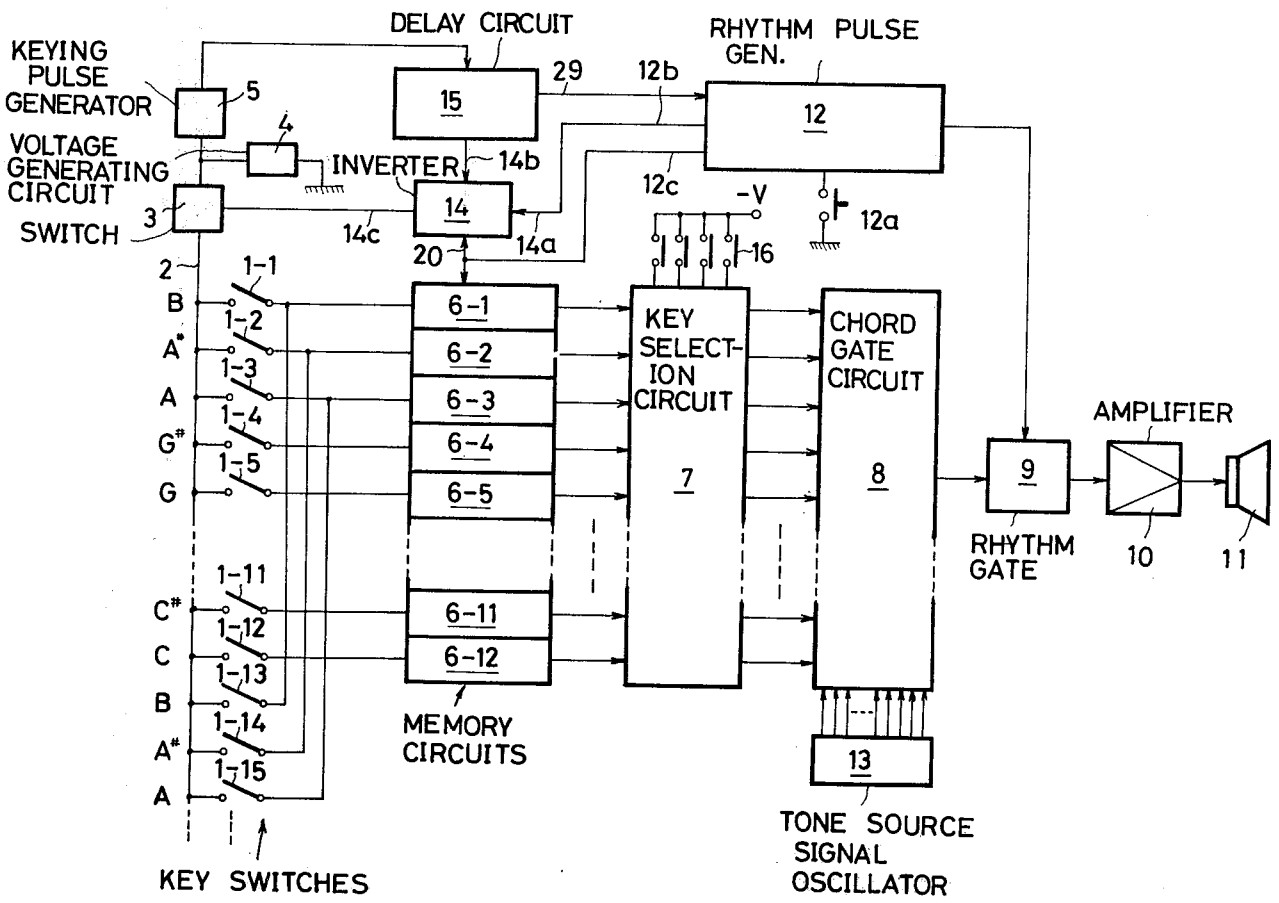
FIG. 1 is a block diagram showing one embodiment according to the invention.

Referring to FIG. 1, numerals 1-1, 1-2, . . . 1-15 . . . denote key switches for rhythm accompaniment positioned to be closed with respective keys of a keyboard for melody. These key switches 1-1 . . . 1-15 . . . are connected at respective ends to a common conductor 2 and the conductor 2 is connected through a switch element 3 to an electric voltage generating circuit 4 and a keying pulse generator 5. The key switches 1-1, . . . 1-15 . . . are connected at their other ends to a speaker 11 through memory circuits 6-1 . . . 6-12, a key selection circuit 7, a chord gate circuit 8, a rhythm gate 9 and an amplifier 10.

Numeral 12 denotes a rhythm pulse generator driven by a start pulse generated by a pulse of the keying pulse generator 5 so as to generate a rhythm pulse according to a rhythm previously set, and thereby the rhythm gate 9 is controlled to open and close and a rhythm tone of a chord is obtained from the speaker 11.

Numeral 13 denotes a tone source signal oscillator and **12*a* denotes a stop switch for the rhythm pulse generator 12. The rhythm pulse generator 12 has also a terminal 12*b* issuing a pulse representing one bar of music, and the terminal 12*b* is connected to one input terminal 14*a* of an inverter circuit 14 comprising a flip-flop circuit, and the other input terminal 14*b* thereof is connected through a delay circuit 15 to an output terminal of the keying pulse generator 5**. The delay time is very short, of the order of 20 m sec.

If an electric source is applied under the condition as shown in FIG. 1, the output at an output terminal **14*c* of the inverter circuit 14 becomes "H," and the switch element 3 is in ON condition and thus a musical performance can be made at any time. Next, when a key of the melody keyboard is depressed and the key switch 1-1 is closed, an electric voltage of the voltage generating circuit 4 is applied to the first memory circuit 6-1 and it is memorized therein that the key switch 1-1 has been closed, and at the same time a keying pulse is generated from the keying pulse generator 5 so as to drive the rhythm pulse generator 12 and cause the delay pulse generator 15 to generate a delay pulse and accordingly the inverter circuit 14** is inverted and the output thereof becomes "L" to open the switch element 3. Thus, even if, after the switch element is opened, a melody performance is made and thereby any of the key switches 1-1 . . . 1-15 . . . is closed, a signal does not enter the memory circuits (6-1) . . . (6-12), so that the foregoing memory remains unchanged.

The output of the memory circuit 6-1 which has memorized the closed condition of the key switch 1-1 is passed through the key selection circuit 7, so that a chord signal corresponding to a key selected by a selection switch 16 is generated and a corresponding gate of the chord gate circuit 8 is opened and rhythm gate 9 is opened in accordance with a rhythm pulse generated by the rhythm pulse generator 12, whereby a rhythm tone of the chord can be obtained from the speaker 11.

In this manner, a rhthym accompaniment tone can be obtained, and on going to the performance of a second bar after the performance of the first bar is ended, a pulse representing the second bar is generated from the terminal 12*b* of the rhythm pulse generator 12 and the inverter circuit 14 is inverted, that is, it is returned to the original condition before depression of a key so as to generate output "H," whereby the switch element 3 is closed in readiness for performance of the second and subsequent bars of the melody keyboard. Next, if another key switch 1-3 is closed, this closing is memorized in the memory circuit 6-3, and the memory in the memory circuit 6-1 is released, so that a rhythm accompaniment tone of another chord can be obtained, and also the inverter circuit 14 is inverted by a delay pulse generated by the closing of the key switch 1-3, and the switch element 3 is opened, and thus even if any of the key switches 1-1 . . . 1-15 . . . is thereafter closed during the performance of the second bar, the memory circuits 6-1 . . . 6-12 are not operated, so that the rhythm accompaniment tone is not changed.

Thus, by depressing the key corresponding to the first melody tone in each bar, there can be obtained a rhythm accompaniment tone corresponding to that melody tone.

In the event that in any of the bars the first melody tone of that bar is a rest or pause, in the conventional rhythm accompaniment apparatus, there is introduced the disadvantage that both the melody tone and the rhythm accompaniment tone are halted, and thus an interruption of the performance is brought about.

According to the invention, the memory of the memory circuit is maintained simply by the arrangement wherein when the rhythm accompaniment of one bar is ended the switch element 3 is closed to be ready for the rhythm performance of the next bar, as mentioned above. Accordingly, even if the first tone of the next bar is a pause, the preceding rhythm accompaniment tone is constantly produced so that interruption of the performance is not brought about.

Additionally, even in the case in which a key for the first melody tone of the next bar is depressed with a delay, no interruption of the performance is brought about in almost the same manner as above.

In this case, only after that key is depressed, will the previous rhythm accompaniment tone be changed into a rhythm accompaniment tone corresponding to that key, and when the performance of that bar is ended, the switch element 3 is closed to be ready for the next bar as mentioned above.

If the stop switch 12*a* is depressed, the driving of the rhythm pulse generator 12 is stopped, and the rhythm accompaniment is stopped.

Figure 2:
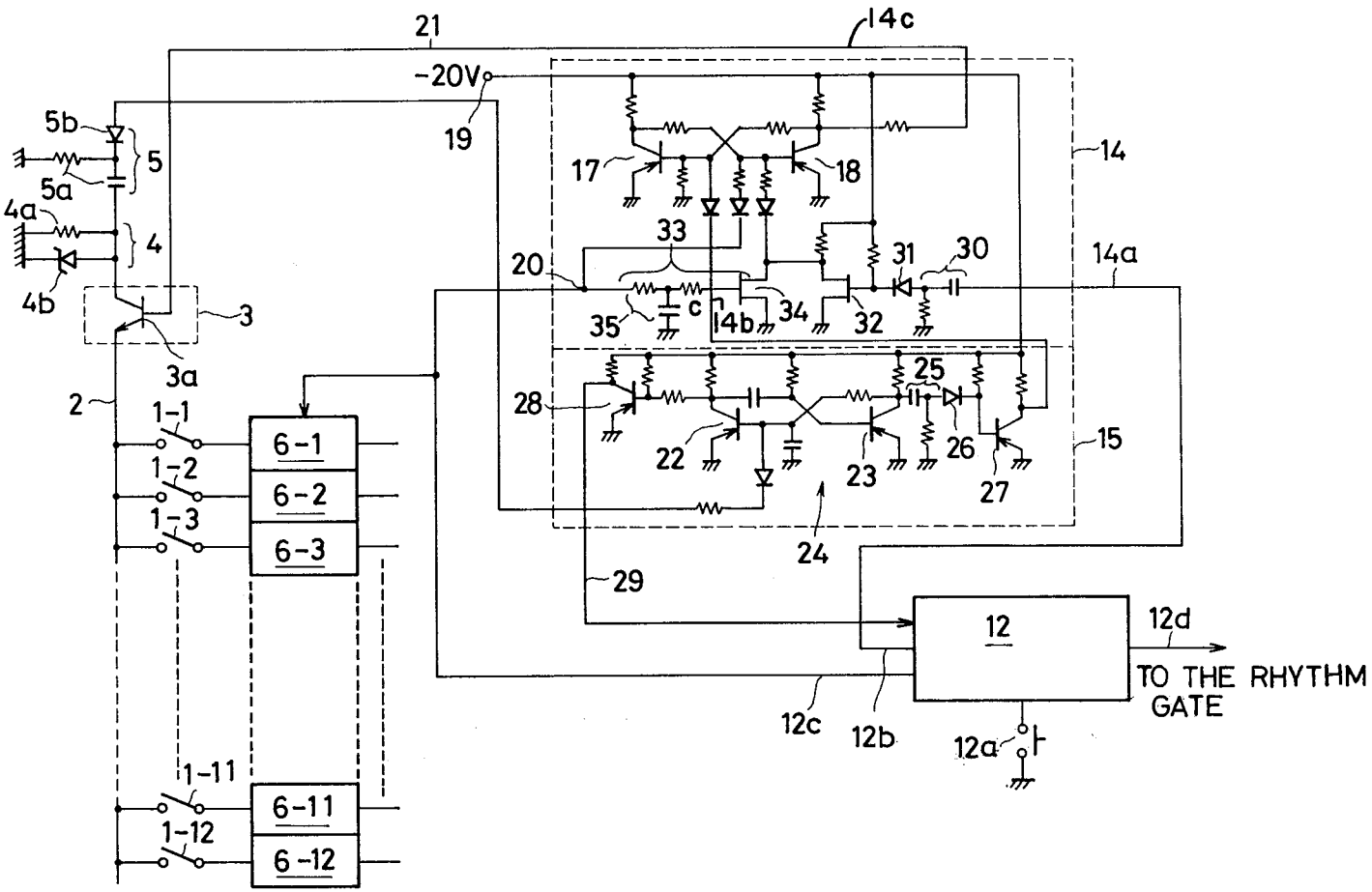
FIG. 2 is a circuit diagram of a part thereof, FIG. 3 (A) shows the waveform at an output terminal of a rhythm pulse generator 12 in FIG. 2, FIG. 3 (B) shows the waveform at the collector of transistor 18 of inversion circuit 14 in FIG. 2, FIG. 3 (C) shows the waveform at an output of keying pulse generator 5 in FIGS. 1 and 2, FIGS. 3 (D) (E) (F) (G) and (H) show respective waveforms at the collector of transistor 28 of delay circuit 15, the collector of transistor 23, the output terminal of differentiation circuit 25, the output terminal of diode 26 and the collector of transistor 27 in FIG. 2, FIGS. 3 (I) and (K) show the waveforms at output terminals **12*b*, 12*d* of the rhythm pulse generator 12, FIGS. 3 (J) shows a waveform at the output of diode 31 of inversion circuit 14 in FIG. 2, FIGS. 4 and 5 are respective circuit diagrams of other parts of FIG. 1.

FIG. 2 shows a detailed circuit diagram of a part of FIG. 1. In FIG. 2, the switch element 3 comprises a transistor 3*a*, interposed in the conductor 2 by being connected at its collector and its emitter. The voltage generating circuit 4 comprises a resistance 4*a* and a constant-voltage diode 4*b* connected in parallel to one another. One of the ends of these members are grounded, and the respective other ends thereof are connected to the collector of the transistor 3*a*. The keying pulse generating circuit 5 comprises a differentiation circuit 5*a* and a diode 5*b* connected to the collector of the transistor 3*a*.

Figures 3A, 3B, 3C, 3D, 3E, 3F, 3G, 3H, 3I, 3J, 3K:
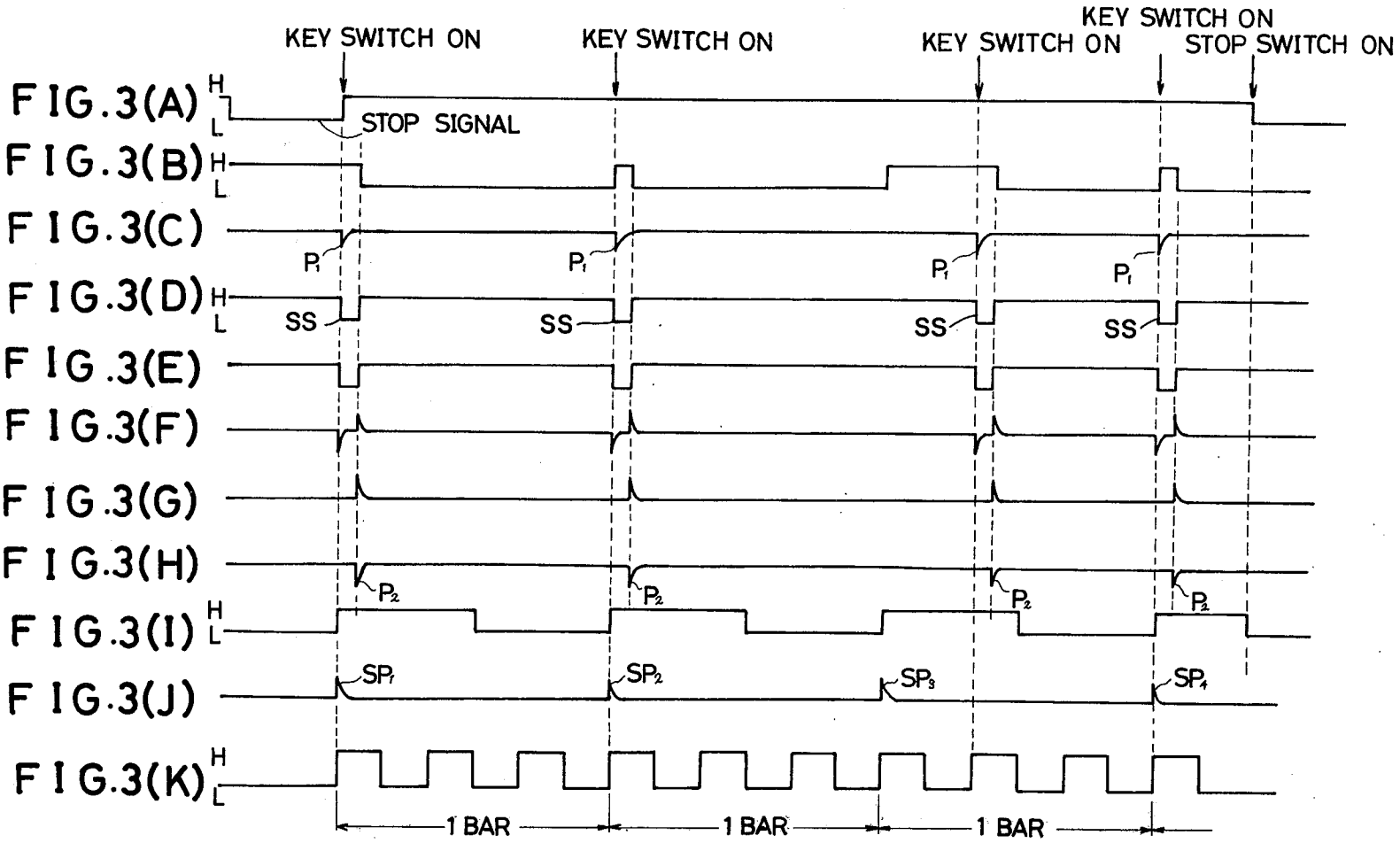

The inverter circuit 14 comprises a flip-flop circuit comprising two transistors 17, 18. When an electric source terminal 19 is supplied with electric power (−20 V), a stop signal L (see FIG. 3(A)) at a stop signal terminal 12C of the rhythm pulse generator 12 is applied to the base of the transistor 18, so that the transistor 18 assumes the "ON" condition. Accordingly, H (a negative electric potential approximately near OV of ground potential) of the collector is passed through the output conductor 21 and is applied to the base of the transistor 3*a* constituting the switch element 3, and the transistor is switched to the "ON" condition. However, as long as none of the key switches 1-1 . . . 1-15 . . . is closed, no electric current will flow through the switch element 3. FIG. 3 (B) shows the output of the collector of the transistor 18.

The delay pulse generating circuit 15 comprises a monostable multivibrator 24 composed of two transistors 22, 23, a differentiation circuit 25 connected to the collector of the transistor 23 on one side, and an inverter 27 comprising a transistor 27 connected through a diode 26 to an output terminal of the differentiation circuit 25. An output terminal of the inverter 27 is connected to an input terminal 14*b* connected to the base of the transistor 17 of the inverter circuit 14. In the condition in which the electrical source is applied in this Figure, the transistor 22 is OFF, and the transistor 23 is ON. Thus, if a key switch is closed, electric current passes through the switch element 3, so that a negative trigger pulse $P_1$ as shown in FIG. 3(C) is generated at the output terminal of the keying signal generating circuit 5, and this switches the transistor 22 "ON" and the transistor 23 "OFF," and after a predetermined definite period of time (for instance, 20 m sec.) they are reversed and thereby the transistor becomes "ON" again. Electrical potential change of the collector of the transistor 23 is shown in FIG. 3 (E). Thus, the waveform thereof is differentiated to become as shown in FIG. 3(F), and is passed through the diode 26 to become as shown in FIG. 3(G), and further is inverted by the inverter 27 to become a negative delayed trigger pulse $p_2$ as shown in FIG. 3(H). This is applied to the inverter circuit 14 so as to turn the transistor 17 ON and the transistor 18 OFF. As a result, the switch element 3 is turned OFF.

Numeral 28 denotes a transistor for generating a start pulse SS (FIG. 3 (D) for starting the rhythm pulse generator 12 when the transistor 22 of the delay circuit 15 is turned ON by a keying pulse, and a terminal 29 connected to a collector thereof is connected to a drive signal input terminal of the rhythm pulse generator 12, and when the transistor 22 is turned ON by generating the keying pulse $p_1$ the start pulse SS is generated.

FIG. 3 (I) shows a waveform generated, repeatedly, at every one bar at the terminal 12*a* of the rhythm pulse generator 12*b*, and this waveform is formed into a trigger pulse $Sp_1$, $Sp_2$ . . . representing the first of each bar as shown in FIG. 3 (J) by passing from the terminal 14a through a differentiation circuit 30 and a diode 31 provided in the inverter circuit 14 shown in FIG. 2, and is further applied to the base of the transistor 18 through an inverter circuit 32. It occasionally happens that the $Sp_1$ to be thus generated at first on musical performance, among the pulses applied to the base of the transistor 18, is delayed in generation due to the characteristic property of the rhythm pulse generator 12 and on such occasion the inverter circuit 32 is inverted thereby. Numeral 33 denotes a cancellation circuit cancelling such a pulse $Sp_1$ in order to prevent this unfavorable occasion, and the cancellation circuit 33 comprises a FET 34 connected in parallel with the inverter circuit 32 and an integration circuit 35 connected between a gate thereof and a terminal 20. Thus, where the stop signal L (−20 V) generated by the rhythm pulse generating circuit shown in FIG. 3 (A) is being applied to the terminal 20, a condenser C of the integration circuit 35 is charged to −20 V.

If, now, a key switch is closed first to drive the rhythm pulse generator 12, and the stop signal L is changed into H as shown in FIG. 3(A), and at the same time the pulse $Sp_1$ is generated as described above and is applied to the gate of the inverter circuit 32 to turn the inverter circuit 32 OFF, the FET 34 is maintained in its ON state, so that the pulse $Sp_1$ is grounded and cancelled. By the cancellation of $Sp_1$ in this way, the transistor 18 is maintained in its OFF state, and the electrical potential of the collector of the transistor 18 becomes L as shown in FIG. 3 (B) and the switch element 3 is closed. Accordingly, there is no change in the memory circuit even if any of the other keys is depressed.

Next, if pulses $Sp_2$ $Sp_3$ . . . of the second and subsequent bars are generated, the condenser C is discharged completely and the FET 34 remains OFF because the stop signal has been changed to H as shown in FIG. 3(A), and therefore the pulses $Sp_2$, $Sp_3$ . . . are turned by the inverter circuit 32 and are applied to the base of the transistor 18, and the inverter circuit 14 is turned and the output thereof becomes "H" as shown in FIG. 3(B), and it will be clear that the circuit is ready for the subsequent performance.

Figure 4:
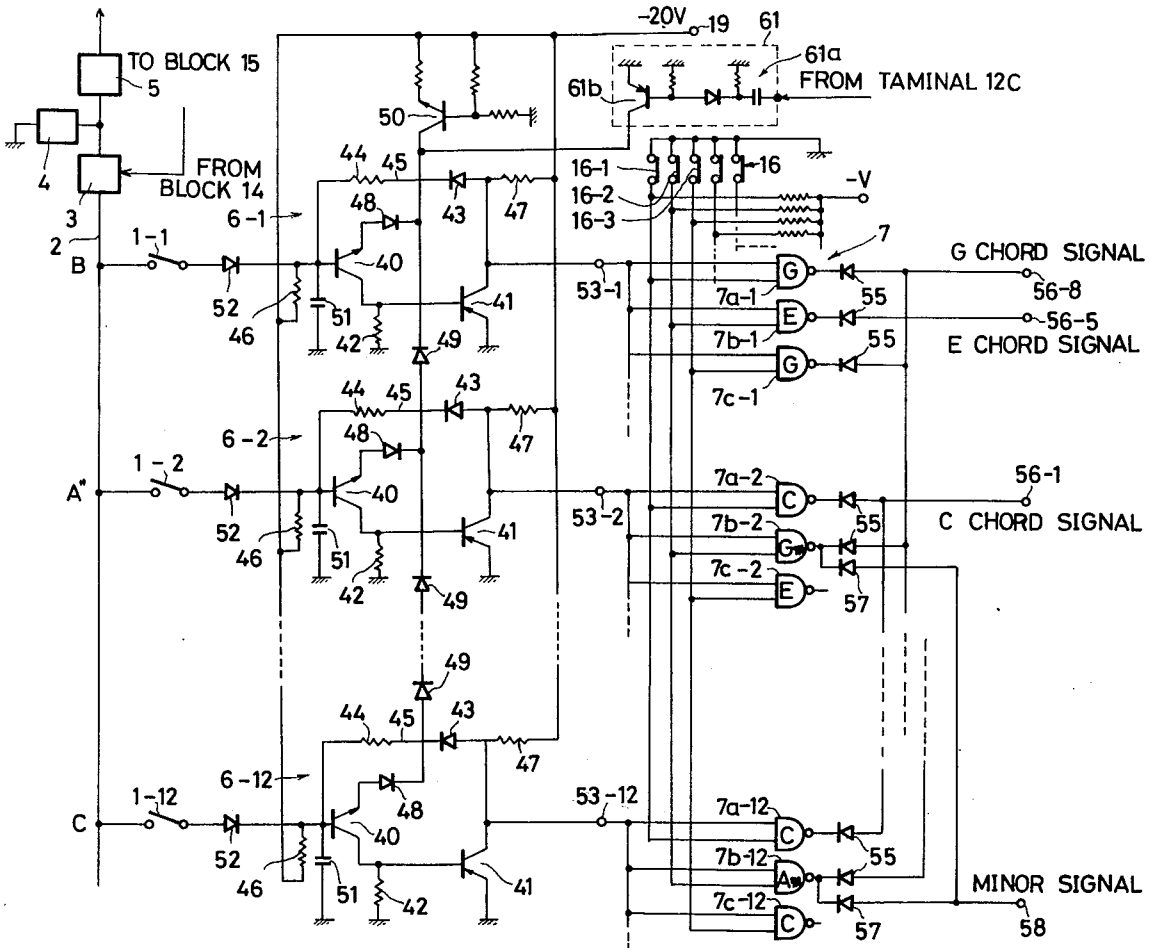

The memory circuits 6-1 . . . 6-12 each comprise first and second transistors 40,41 as shown in FIG. 4. A collector of the first transistor 40 is grounded through a resistance 42 and is connected to a base of the second transistor 41. The emitter of the second transistor 41 is grounded and a collector thereof is connected to a base of the first transistor 40 through a return circuit 45 in which a diode 43 and a resistor 44 are interposed. The base of each first transistor 40 and a collector of each second transistor 41 are connected respectively through resistances 46 and 47 to the electrical source terminal 19, and further the emitter of each first transistor 40 is connected to a diode 48. The cathodes of those diodes 48 are interconnected through respective diodes 49, and the cathode of the first memory circuit 6-1 is connected to the electrical source terminal 19 through a constant-current circuit 50 comprising a transistor. The base of each first transistor 40 is grounded through a condenser 51 and is connected through a diode 52 to a corresponding one of ouput terminals of the key switches 1-1 . . . 1-15.

Outputs 53-1, . . . 53-12 are received from the collectors of the respective second transistors 41 and are connected to the respective input terminals of the key selection circuit 7.

Now, if the key switches 1-1 are closed under the condition that the switch element 3 is ON, the base of the first transistor 40 of the first memory circuit 6-1 assumes a value −6 V which is determined by the constant-voltage diode 4b of the voltage generating circuit 4. Thus, the first transistor 40 is turned ON and thereby the second transistor 41 is turned ON, and an electric potential of the output terminal 53-1 connected to the collector thereof is raised to become "H." This is applied to the key selection circuit 7. At that time, the electric potential of the collector is applied through the feedback circuit 45 of the base of the first transistor 40. If, next, the key switch 1-1 is opened, a low bias given by the resistances 44,46 is applied to the base of the first transistor 40, so that the first and second transistors 40,41 are maintained in their ON states and memorize the fact that the key switch 1-1 was closed, and the output signal H is at the output terminal 53-1.

Next, if the key switch 1-2 is closed, the first and second transistors 40,41 of the second memory circuit 6-2 are turned ON in the same manner as mentioned above, and output terminal 53-2 becomes H. At that time, the first transistor 40 of the second memory circuit 6-2 is turned ON by the optimum electrical voltage (−6 V) given by the voltage circuit 4 to the base thereof, whereas, the first transistor 40 of the first memory circuit 6-1 has already been turned ON by the low electric potential given through the return circuit 45 and the resistance 46. The electric current flowing through constant-current circuit 50 is not increased, so that the current flowing through the collector of the first transistor 40 of the first memory circuit 6-1 becomes very small, and as a result the second transistor 41 of the first memory circuit 61 is in OFF state and the first transistor 40 thereof also is OFF, whereby the memory is released. On the other hand, the base of the first transistor 40 of the second memory circuit 6-2 is supplied with the voltage −6 V during the time when the closing of the key switch 1-2 is continued, and the first and second transistors 40,41 are in their ON states, and after the key switch 1-2 is opened, the transistors are maintained in ON state by the feedback circuit 45 and the output terminal 53-2 continues to supply output H.

Next, if the two key switches 1-1, 1-2 are closed simultaneously, the first transistor 40 of the first and second memory circuits 6-1, 6-2 are going to become "ON," but because in the collector of the first transistor 40 of the second memory circuit 6-2 there is a voltage which is smaller by such an amount to correspond to the diode 49 as compared to the voltage in the collector of the first transistor 40 of the first memory circuit 6-1, only the first transistor 40 of the first memory circuit 6-1 becomes ON with priority, and also the second transistor 41 thereof becomes ON, so that there is obtained an output signal H at the output terminal 53-1. This can be applied also to such a case where two or more key switches which are located apart one from another are closed simultaneously.

Thus, as mentioned above, if any of the respective key switches 1-1 . . . 1-15 are closed under the condition that the switch element 3 is ON, it is memorized in the corresponding one of the respective memory circuits 6-1, . . . 6-12, and in the case that two or more key switches closed simultaneously, only the key switch on the higher side in interval is given a priority for memorization.

The key selection circuit 7 serves to select in accordance with the key of music to be played, and it is so constructed that a chord which is suitable in relation to the first tone of each bar of a melody may be selected.

If, now, chords are considered concerning music in C minor, A minor, G minor or D minor, those are as shown in the following Table.

| Key | Chord | | | |
|---|---|---|---|---|
| Tone name | C major | A minor | G major | D minor |
| B | G | E | G | A |
| A# | C | Gm | E | Gm |
| A | F | Am | D | Gm |
| G# | E | E | B | Gm |
| G | C | Dm | G | Gm |
| F# | D | B | D | E |
| F | F | Dm | E | Dm |
| E | C | Am | G | Dm |
| D# | B | F | E | A |
| D | G | Dm | G | Dm |
| C# | A | A | B | A |
| C | C | Am | C | B |

A circuit is shown in FIG. 4 so that any of the chords described in the above Table may be selected by selective operation of the key selection circuits 16-1, 16-2 . . . 16-12.

Namely, NAND circuits 7a-1 . . . 7a-12, 7b-1 . . . 7b-12, 7c-1 . . . 7c-12 . . . for C major, A minor etc. are provided. Those circuits are formed into respective groups, in respect with those having the same end number by being connected through a common connector together to form a group, and are connected through their respective common connectors to respective output terminals 53-1, . . . 53-12 of the memory circuits 6-1 . . . 6-12, and also input terminals on the other side thereof are formed as groups and are connected to the respective switches 16-1, 16-2 . . . of the C major, A minor etc. tones.

As will be clear from the above Table, the same chords appear for each key, so that, among output terminals of the NAND circuit, the output terminals, from which the same chord signals are obtained, are connected through respective diodes 55 to C,C#, D . . . A# and B, chord signal output terminals 56-1 . . . 56-12.

Further, the NAND circuits for the output of the minor chords are connected to the output terminals 56-1, . . . 56-12 in almost the same manner as the case of the respective major chords, and also are connected through respective diodes 57 to a minor signal terminal 58.

Thus, if, now, the selection switch 16-1 for the key of C major is closed and a key for the B tone is depressed, the key switch 1-1 is closed, and the output terminals 53-1 of the first memory circuit 6-1 becomes H as mentioned above, and the inputs of the NAND circuit 7a-1 become "H,H" and a chord signal "L" is obtained at the G chord signal output terminal 56.

Also, if the selection switch 16-2 is closed and a key for the A# tone is depressed, the key switch 1-2 is closed, and the output terminal 53-2 of the second memory circuit 6-2 becomes H, and inputs of the NAND circuit 76-2 become "H,H," and a chord signal "L" is obtained at the G chord signal output terminal 56-8, and at the same time a minor signal "L" is obtained at the minor signal output terminal 58.

Figure 5:
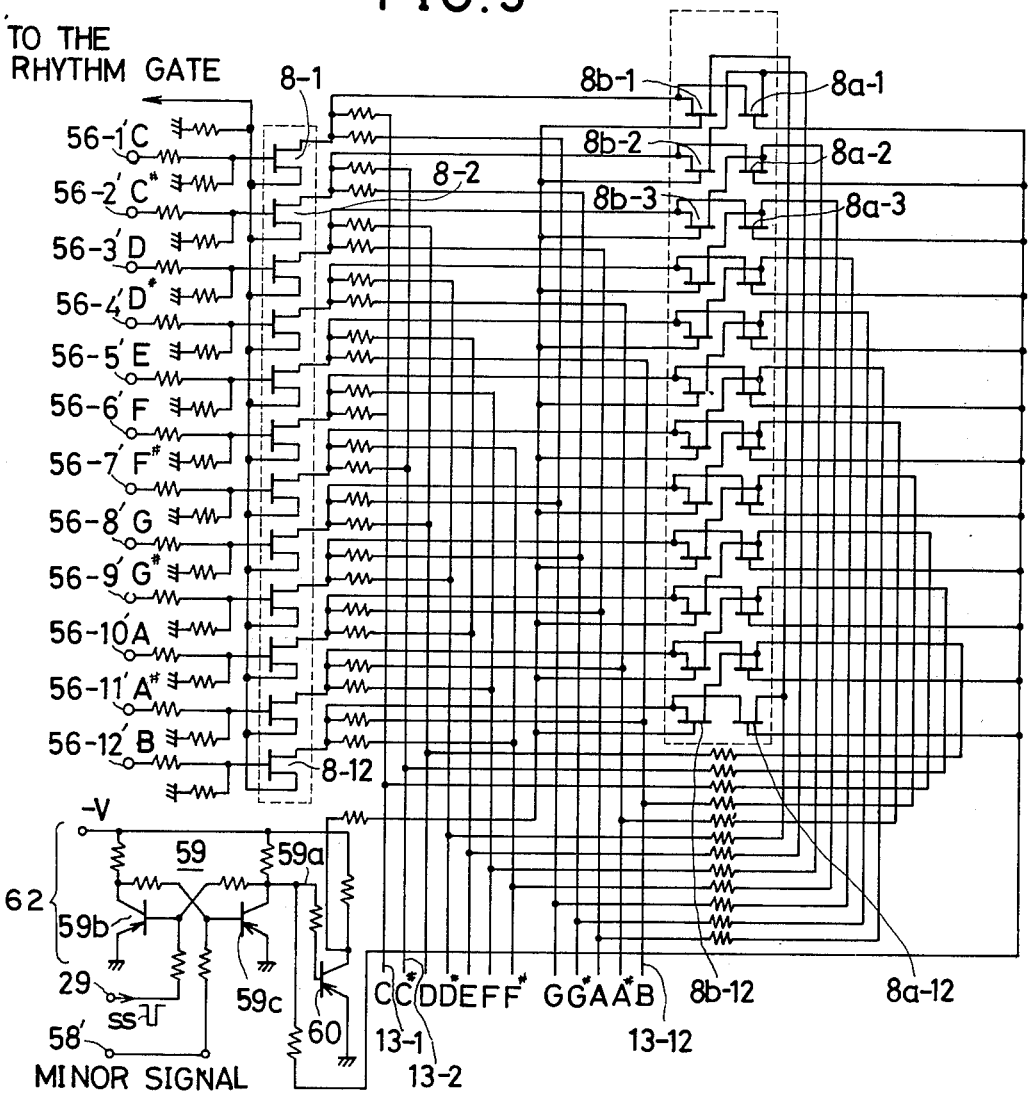

Thus, the chord signal "L" is obtained at the chord signal output terminals 56-1, . . . 56-12 in accordance with a key of a melody, and when a minor chord is selected, the chord signal "L" is obtained at the foregoing output terminals 56-1, . . . 56-12 and at the minor signal terminal 58. Those output terminals 56-1, . . . 56-12 and 58 are connected to input terminals 56-1' . . . 56-12' and 58' of the chord gate circuit 8 shown in FIG. 5.

The chord gate circuit 8 is provided with twelve gate circuits 8-1 . . . 8-12 comprising FETs connected at gate electrodes to the input terminals 56-1' . . . 56-12', and each of the input terminals of these gate circuits is connected to those tone source signal conductors 13-1 . . . 13-12 of the tone source signal oscillator 13 that have 1st and 5th degrees relations thereto and also to such ones of those conductors 13-1 . . . 13-12 that have major 3rd and minor 3rd degree relations thereto through respective major 3rd gates 8a-1, . . . 8a-12 and respective minor 3rd gates 8b-1 . . . 8b-12.

Additionally, a changeover circuit 62 comprising a flip-flop circuit 59 and an inverter circuit 60 connected to an output terminal 59a of the flip-flop circuit 59 is provided, and the output terminal 59a of the flip-flop circuit 59 is connected to respective gate electrodes of the FETs constituting respectively the major 3rd gates 8a-1, . . . 8a-12, and an output terminal of the inverter circuit 60 is connected to respective gate electrodes of the FETs constituting respectively the minor 3rd gates 8b-1, . . . 8b-12.

The flip-flop circuit 59 comprises two transistors 59b, 59c, and the input terminal 58' is connected to a base of the transistor 59c on one side, and the driving signal output terminal 29 of the delay circuit 15 shown in FIG. 1 is connected to the base of the transistor 59b on the other side.

Thus, if the key switch 1-1 is closed, the start pulse SS shown in FIG. 3 (D) is applied to the base of the transistor 59b and turns this ON and turns the transistor 59c OFF. If, now, the cord signal "L" is generated at the G chord output terminal 56-8 of the key selection circuit 7, and the minor signal terminal 58 is "H," the collector, which is the output terminal 59a of the transistor 59c becomes "L", and the respective major 3rd gates 8a-1, . . . 8a-12 are opened. Thus, the G chord gate 8-8 is opened by the chord signal L, so that musical tone signals D,G,B are allowed to pass therethrough and the G chord tone is obtained.

Next, if the key switch 1-2 is closed and the key of A minor is selected, the signal L is generated at the G chord output terminal 56-8 and at the minor signal terminal 58, and the former opens the G chord gate 8-8 and the latter turns the flip-flop circuit 59, so that the transistor 59b is OFF and the transistor 59c is ON, and consequently, the output of the inverter circuit 60 becomes L turning the minor 3rd gates 8b-1, . . . 8b-12 ON. Thus, musical tone signals D G A# are allowed to pass through the G chord gate 8-8 and the Gm tone is obtained.

Thus, a chord is obtained in accordance with a key depressed and the music to be played.

The above has been explained with regard to the case of a chord of 1st, 3rd and 5th degrees. It will be clear that the construction can be designed to obtain any desired chord of 1st, 3rd and 7th degrees, 3rd, 5th and 7th degrees or others only by change in connection thereof.

Referring to FIG. 4, numeral 61 denotes a circuit for discharging the memories of the respective memory circuits 6-1, . . . 6-12 by a stop signal L generated at the terminal 12c when the stop switch 12a of the rhythm pulse generator 12 shown in FIG. 1 is depressed. The circuit 61 comprises a pulse generating circuit 61a and a transistor 61*b* interposed in a circuit for connecting a collector of the transistor of the constant-current circuit 50 to the ground, the arrangement being such that the memories of the respective memory circuits 6-1 . . . 6-12 are released when the transistor 61*b* is made conductive by the pulse generated by the stop signal L.

The embodiment is described above in such an apparatus that chords corresponding to a first tone of each bar in melody performance, are set therein so that an automatic accompaniment performance can be carried out in relation to the melody to be played. However, with progress in the techniques of performance, a player finds such an automatic performance unsatisfactory. Such a case also can be considered in which the player has the desire to play with an additional accompaniment by freely selecting any other chord than the predetermined chords previously set for automatic accompaniment.

Figure 6:
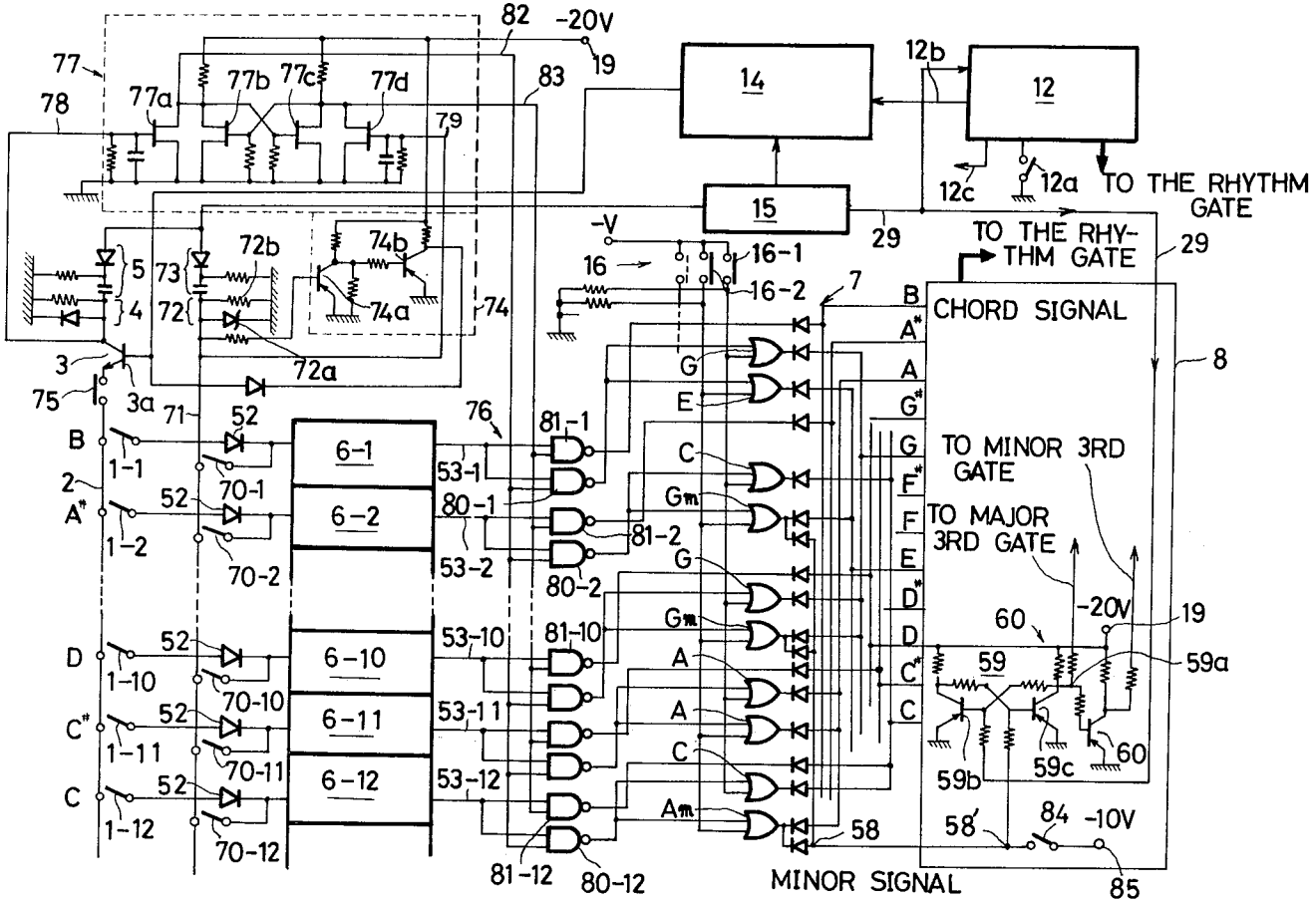
FIG. 6** is a circuit diagram of another embodiment according to the invention.

FIG. 6 shows an apparatus that meets such a requirement. Portions corresponding to those in FIG. 1 to FIG. 5 described above are denoted by the same reference numerals.

There is provided a keyboard for accompaniment of a one finger system, and key switches 70-1, . . . 70-12 thereof are connected at one end to the cathodes of diodes 52 interposed in circuits connecting the key switches for melody accompaniments 1-1 . . . 1-12 and the respective memory circuits 6-1, . . . 6-12. The key switches are connected at their other ends through common conductor 71 to an electric voltage generating circuit 72 comprising a constant-voltage diode 72*a* and a resistor 72*b*, and the key switches are further connected through a differentiation circuit 73 to the output terminal of the differentiation circuit 5.

The conductor 71 is connected through a one finger chord priority circuit 74 to the control electrode of the switch element 3. The priority circuit 74 comprises two transistors 74*a*, 74*b* connected in series, so that when any of the key switches 70-1 . . . 70-12 is closed, an electric voltage (−6 V) generated at the conductor 71 turns the transistor 74*a* ON and the transistor 74*b* OFF and thereby the switch element 3 is turned OFF, whereby even if the melody keyboard is thereafter depressed, no change in the memory of any of the memory circuits 6-1, . . . 6-12 is brought about.

A circuit connecting the key switches 1-1, . . . 1-12 and the switch element 3 is provided with a switch 75 interposed therein, and the collector of a transistor 3*a* constituting the switch element 3 and the conductor 71 are respectively connected to side input terminals 78 and 79 of a control circuit 77 which controls a selection circuit 76 comprising a flip-flop circuit and carrying out selection of a one finger chord and a melody accompaniment chord.

The control circuit 77 comprises a flip-flop circuit composed of four FETs 77*a* . . . 77*d*, so arranged that gate electrodes of the FETs 77*a*, 77*d* at both ends may be each supplied with voltage (−6 V) generated in the respective conductors 2,71 by closing the key switches 1-2, . . . 1-12 and the key switches 70-1, . . . 70-12.

The selection circuit 76 comprising plural NAND circuits for melody chords 80-1 . . . 80-12 and plural NAND circuits for one finger chords 80-1 . . . 81-12 are respectively connected at one of their side terminals to the memory circuits 6-1, . . . 6-12. An output terminal 82 on one side of the control circuit 77 is connected to input terminals on the other side of the NAND circuits for melody chords 80-1 . . . 80-12, and the other output terminal 83 of control circuit 77 is connected to the other input terminals of the NAND circuits for one finger chords 81-1 . . . 81-12. The output terminals of the NAND circuits for one finger chords 81-1 . . . 81-12 are connected to the gate circuits 8-1 . . . 8-12 of the chord gate circuit 8 directly corresponding thereto.

The NAND circuits for melody chords 80-1 . . . 80-12 are connected through the key selection circuit 7 to the respective gate circuits 8-1 . . . 8-12 of the chord gate circuits in almost the same manner as shown in FIG. 4. The key selection circuit 7 is constructed by using OR circuits, and the minor signal terminal 58 is led out therefrom and is connected to the terminal 58' of the chord gate circuit 8 in a similar manner as in the case shown in FIG. 5. The terminal 58' of the chord gate circuit 8 is connected to a terminal 85 of an electrical source (−10 V) through a switch 84.

Thus, this embodiment is not different from that explained with reference to FIGS. 1 to 5 in that a melody tone and an accompaniment tone can be obtained by operating the melody keyboard when the switch 75 is closed. It is different in the following respects. Namely, the voltage (−6 V) generated at the collector of the transistor constituting the switch element 3 when any of the key switches 1-1 . . . 1-12 is closed, turns the FETs 77*a*, 77*b* of the control circuit 77 ON and the FETs 77*c* 77*d* OFF, and "H" is applied to the other side input terminals of the NAND circuits for melody accompaniment 80-1 . . . 80-12, whereby those are selected and the outputs of the NAND circuits corresponding to the output of the memory circuits 6-1 . . . 6-12 become L and a chord corresponding to the key is obtained.

Next, the simultaneous operation of the keyboard for melody and the keyboard for one finger chords are carried out under the closed condition of the switch 75, the conductor 71 is lowered in electric voltage to −6 V given by the voltage generating circuit 72, by closing of the key switches 70-1 . . . 70-12 of the latter, and as mentioned above the transistor 74*a* of the priority circuit 74 is turned ON and the transistor 74*b* is turned OFF and the base of the switch element 3 is lowered to L and is turned OFF. A pulse obtained at the differentiation circuit 73 is applied to the delay circuit 15 and the rhythm pulse generator 12 is driven and after the lapse of a delay time (20 m sec.) the output of the inverter curcuit 14 becomes L and keeps the switch element 3 in its OFF state. On the other hand, the L of the conductor 71 is applied to the input terminal 79 of the control circuit 77 and the FETs 77*c*, 77*d* are turned ON to select the NAND circuits for one finger chords 81-1 . . . 81-12. Thus, the outputs of the memory circuits 6-1 . . . 6-12 are applied, without passing through the key selection circuit 7, to the chord gate circuit 8, and chords corresponding to the key switches 70-1, . . . 70-12 can be obtained. Even if the melody keyboard is then operated before the playing of one bar is completed, any change in the chords is not made because the switch element 3 is kept in its OFF state. It will be, appreciated, however, that a desired change in chord can be made by operation of the keyboard for one finger chords.

If the keyboard for melody is depressed a little earlier than the keyboard for one finger chords, there can be obtained a chord corresponding to the melody tone, but this is corrected instantly by closing of the key switches 70-1 . . . 70-12, so that there is no problem from the auditory point of view.

Next, when the keyboard for one finger chords is operated under the open condition of the switch 75, it will be clear that the rhythm pulse generator 12 is driven by a pulse generated from the differentiation circuit 73, and by the closing of the key switches 70-1 . . . 70-12 the NAND circuits 81-1 . . . 81-12 are selected through the control circuit 77 as mentioned above, and chords corresponding to the closing of the key switches 70-1 . . . 70-12 are obtained.

With further reference to FIG. 6, the above explanation has been made for the case in which a major chord is obtained by operation of the one finger board keyboard.

The switch 84 of the chord gate circuit 8 is located near the one finger chord keyboard, for instance, and is depressed together with the keyboard in the case of performance of a minor chord. Thus, as in the same manner as explained with reference to FIG. 5, the transistor **59*c* of the flip-flop circuit 59 of the changeover circuit 62 is turned ON and the signal L is generated from the inverter circuit 60 to open the minor 3rd gates 8*b*-1 . . . 8*b*-12**. Thus, a minor chord can be obtained in the same manner as above.

Even if the switch 84 is then opened, the minor chord is continued because the memory thereof is kept memorized in the flip-flop circuit 59.

If it is now assumed that after one bar of the minor chord is completed and the next bar is major, the flip-flop circuit 59 is turned by the start pulse generated from the terminal 29 of the delay circuit 15 because the switch 84 remains open, and the transistor **59*b* is turned ON and the transistor 59*c* OFF and the collector thereof becomes L and the output of the inverter circuit 60 becomes L to open the respective major 3rd gates 8*a*-1 . . . 8*a*-12 and a major chord is obtained. As regards the remaining operations, the embodiment of FIG. 6 is not different from that explained with reference to FIG. 5**.

Thus, according to this invention, no interruption of rhythm accompaniment occurs even at the time when there is no operation of the melody keyboard, and the performance can be continued smoothly. Additionally, any desired accompaniment by a one finger rhythm keyboard can be obtained with priority over an automatic accompaniment by the melody keyboard. Further, a minor chord can be obtained by operation of a switch provided on the accompaniment keyboard of the one finger system. Because of the arrangement on which when performance of one bar of a minor chord is completed it is automatically changed into major, no switch operation is needed in the case of performance in major and thus the operation may be made very easily.

What is claimed is:

1. In an automatic accompaniment apparatus in an electronic organ having a keyboard for melody provided with a plurality of key switches for accompaniment, respective first ends of the key switches being connected to a voltage generating circuit and respective other ends of the key switches being connected to memory circuits, the memory circuits having outputs connected to a key selection circuit, a chord gate circuit connected to the key selection circuit for being opened and closed thereby, a rhythm pulse generator, and a rhythm gate controlled by the rhythm pulse generator, the chord gate circuit and rhythm gate being interposed in a circuit connecting a tone source oscillator and a speaker for producing in the speaker a rhythm accompaniment tone corresponding to the first tone in each bar of a melody, the improvement comprising a circuit connected between the key switches and the voltage generating circuit including a switch element having a control electrode, a keying pulse generator having input and output terminals, the input terminal being connected to said switch element, a delay circuit connected to the output terminal of the keying pulse generator and an inverter connected to said delay circuit and to said control electrode of the switch element, said inverter and delay circuit being connected to said rhythm pulse generator such that the inverter is activated by a first pulse in one bar of the rhythm pulse generator to generate a signal for bringing said switch element into "ON" position, and a signal for bringing said switch element into "OFF" position is generated by a delay pulse from said delay circuit.

2. An automatic accompaniment apparatus in an electronic organ as claimed in claim 1, comprising diodes connecting the respective memory circuits so that when a plurality of said key switches are closed simultaneously one of them is given priority for memorization in the memory circuits.

3. An automatic accompaniment apparatus in an electronic organ as claimed in claim 1, wherein the key selection circuit comprises a plurality of logic circuits respectively connected to the outputs of respective memory circuits and key selection switches, the respective logic circuits having output terminals and a minor signal output terminal connected to the output terminals of the logic circuits.

4. An automatic accompaniment apparatus in an electronic organ as claimed in claim 3 wherein said chord gate circuit includes a plurality of gate circuits connected to the output terminals of the respective logic circuits of the key selection circuit, the tone source signal oscillator having a plurality of output terminals, each input of the gate circuits being connected to at least two output terminals of the tone source signal oscillator that have relations of 1st and 5th degrees or relations of 1st and 7th degrees thereto and also is connected to such two output terminals thereof that have relations of major 3rd degree and minor 3rd degree thereto, the gate circuits corresponding to the major 3rd and minor 3rd being connected for control by a signal from the minor signal output terminal of the key selection circuit.

5. An automatic accompaniment apparatus in an electronic organ as claimed in claim 4, comprising an accompaniment keyboard of a one finger system with the plurality of key switches connected at respective ends to input terminals of said memory circuits, another electrical voltage generating circuit and another keying pulse generator connected to the other of the ends of the key switches of the accompaniment keyboard, a priority circuit connected to said other ends of the key switches of the accompaniment keyboard, said priority circuit being connected to the control electrode of said switch element, and a changeover circuit for change over between a melody accompaniment and a one finger accompaniment interposed between the respective memory circuits and the key selection circuit, a plurality of output terminals of the melody accompaniment chord signals being connected to the key selection circuit, and a plurality of output terminals of one finger accompaniment chord signals being connected, without interposition of the key selection circuit, directly to the chord gate circuit and a control circuit arranged to be turned by respective operations of any key switch for melody accompaniment and any key switch for one finger accompaniment, so that the changeover circuit is controlled by the output thereof.

6. An automatic accompaniment apparatus in an electronic organ as claimed in claim 5, wherein said chord gate circuit includes a 3rd degree changeover circuit having two input terminals and two output terminals connected respectively to a control electrode of each major 3rd gate circuit and a control electrode of each minor 3rd gate circuit, such that one of the input terminals is supplied with a start pulse and there is generated at one of the output terminals a signal for opening each major 3rd gate circuit and the other of the input terminals is connected to an electric source through a switch and is inverted by operation of the switch so as to generate at the other output terminal a signal for opening each minor 3rd gate circuit.

* * * * *